US006280047B1

(12) United States Patent
Chen

(10) Patent No.: US 6,280,047 B1
(45) Date of Patent: Aug. 28, 2001

(54) SCREWDRIVER

(76) Inventor: Kun Chen Chen, No. 6, Lane 609, Sec. 1, Chung Shan Road, Tachia Chen, Taichung Hsien (TW)

( * ) Notice: Subject to any disclaimer, the term of this patent is extended or adjusted under 35 U.S.C. 154(b) by 0 days.

(21) Appl. No.: 09/417,026

(22) Filed: Oct. 12, 1999

(51) Int. Cl.[7] ..... B25B 23/18
(52) U.S. Cl. ..... 362/120; 362/578
(58) Field of Search ..... 362/119, 120, 362/578; 81/177.85, 180.1, 438

(56) References Cited

U.S. PATENT DOCUMENTS 5,713,656 * 2/1998 Lin ..... 362/120
6,050,698 * 4/2000 Lee ..... 362/120
6,199,998 * 3/2001 Hsiao ..... 362/119

* cited by examiner

*Primary Examiner*—Stephen Husar
(74) *Attorney, Agent, or Firm*—Bacon & Thomas, PLLC

(57) ABSTRACT

One side of this screwdriver is cylindrical, its inner diameter's circumference face is the positioning section, and the other side of it is rod body, the end of this rod body is the extractor that is equipped with the bit. Furthermore, the gripping rod is composed of a central hollow main body whose two ends are threaded with the forward cover and the tail cover respectively. Forward cover is located at one side of the extractor; it contains a lighting source component, which is consisted of a light bulb and a touch control switch, for achieving the purpose of convenient replacement and providing illumination, etc.

3 Claims, 3 Drawing Sheets

SCREWDRIVER

BACKGROUND OF THE INVENTION

A screwdriver whose bit is replaceable and furthermore the illumination function is provided.

The screwdrivers stated in the Taiwanese Utility Nos. 82219601 and 87204744, as well as the U.S.A. Des. 407, 290 reveal that the bits are replaceable and the illumination function is provided. However, the screwdriver in the U.S.A. patent case is nothing new but new appearance. As for the screwdrivers in these two Taiwanese patents, the configuration of replaceable bits are same as existing technology, and there is no improvement in design.

SUMMARY OF THE INVENTION

The screwdriver is composed of an extractor, and a gripping rod that connects to the extractor for transmitting torque to the bit. When gripping rod's connecting joint has a lighting source component, which is controlled by a power supply switch, and then the extractor (made of a material that allows light to penetrate) could offer illumination function.

One of the purposes is to provide a screwdriver that has a simple configuration and replaceable bit.

One of the purposes is to provide a bit replaceable type of screwdriver that can offer illumination function.

DETAILED DESCRIPTION OF THE PREFERRED EMBODIMENTS

Figure 1:
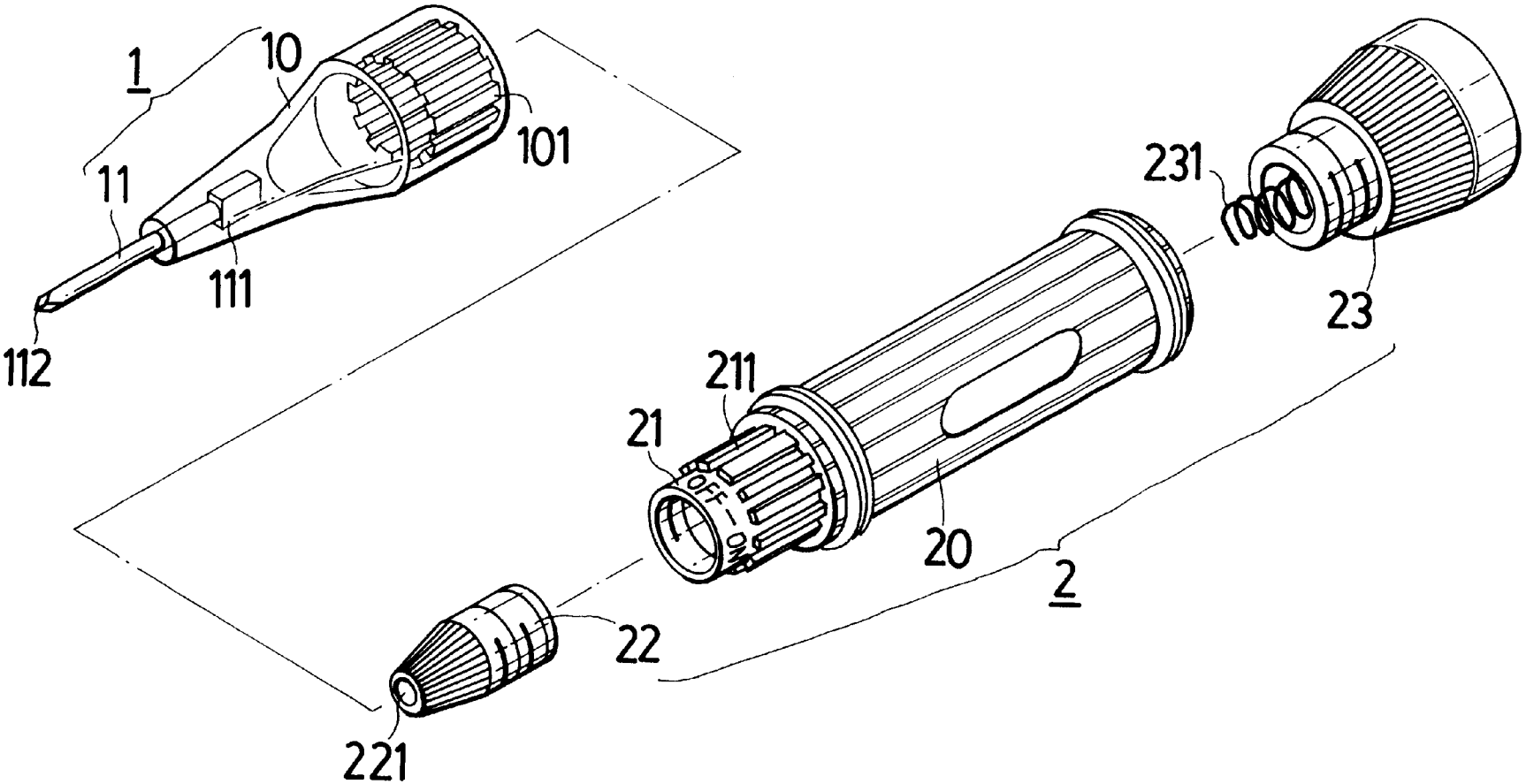
FIG. 1 is the disassembled pictorial drawing of a better implementation example.

In FIG. 1, there is a female joint cover 10 which is made of one of the groups composed of the materials that allows light to penetrate. One side of this female joint cover is cylindrical, and a continuous tooth type of positioning section 101 is set at inside of the inner diameter's circumference face of female joint cover. The other side has a rod body 11 to compose the extractor 1. One side of the rod body 11 is a non-circle block 111; it is covered inside of this female joint cover. The other side is the bit 112 that is exposed to the air, transmits the torque to threaded connecting components or screws.

As for the central hollow tube type of main body 20, one side of it is the inserting section 211 with a smaller diameter and several teeth on its surface; the end of this inserting section is the connecting end 21. The inner diameter of connecting end 21 is threaded with a forward cover 22 which is equipped a lamp hole 221. The other side of main body is threaded with a tail cover 23 which is equipped a spring 231. These above parts configure a gripping rod 2.

Figure 2:
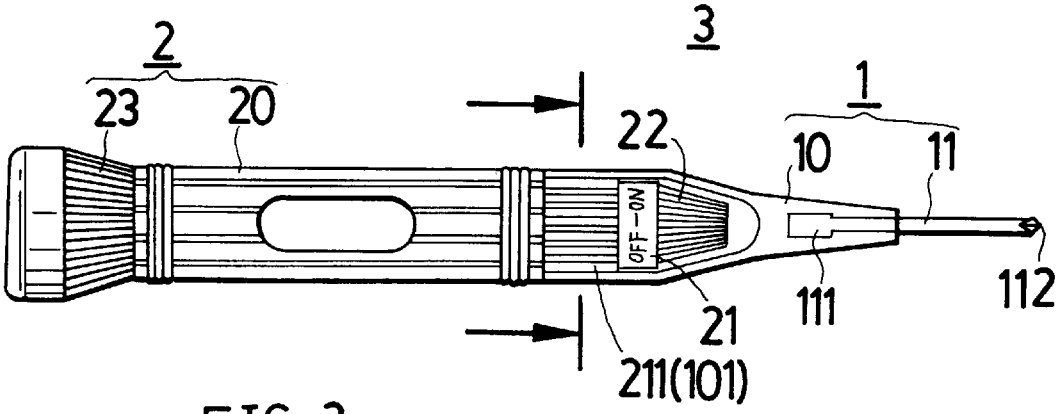
FIG. 2 is the assembly of FIG. 1.
Figure 5:
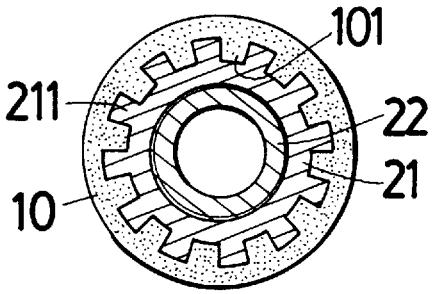
FIG. 5 is the sectional plan of A—A line in FIG. 2.

FIG. 2 and 5 indicate that above extractor 1 and gripping rod 2 are coupled to be this special screwdriver 3. The positioning section 101 of female joint cover 10 is fixed on the inserting section 211 of connecting end 21 of main body 20. When we apply the turning force on the gripping rod 2, through the coupling relationship between inserting section 211 and positioning section 101, the rod body 11 is driven to release the torque to the bit 112 of the threaded locking component.

Figure 3:
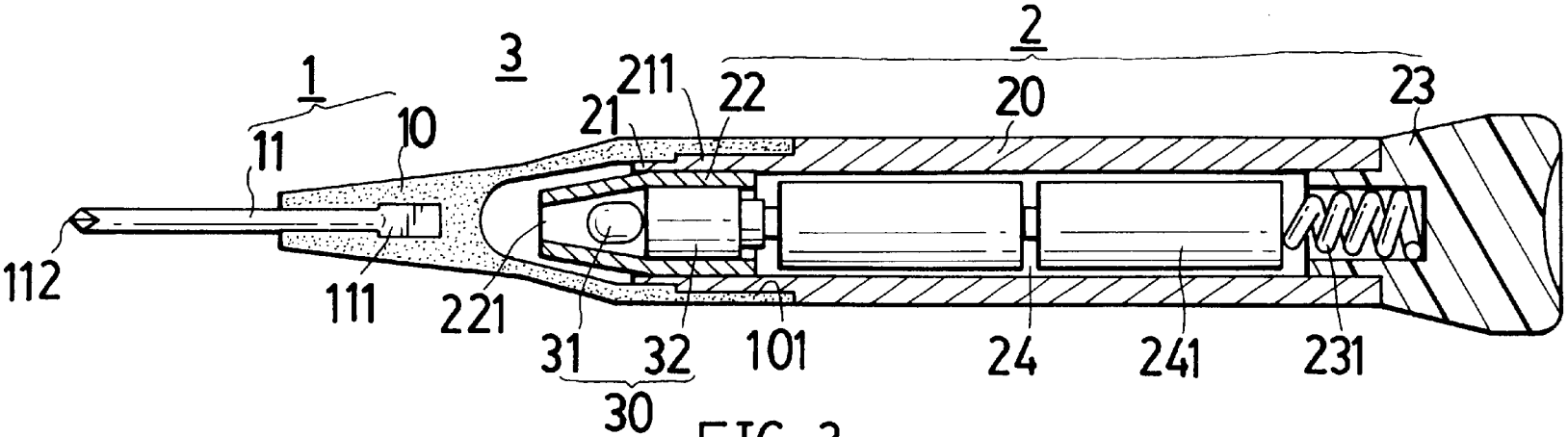
FIG. 3 is the sectional plan of FIG. 2 with illumination.
Figure 4:
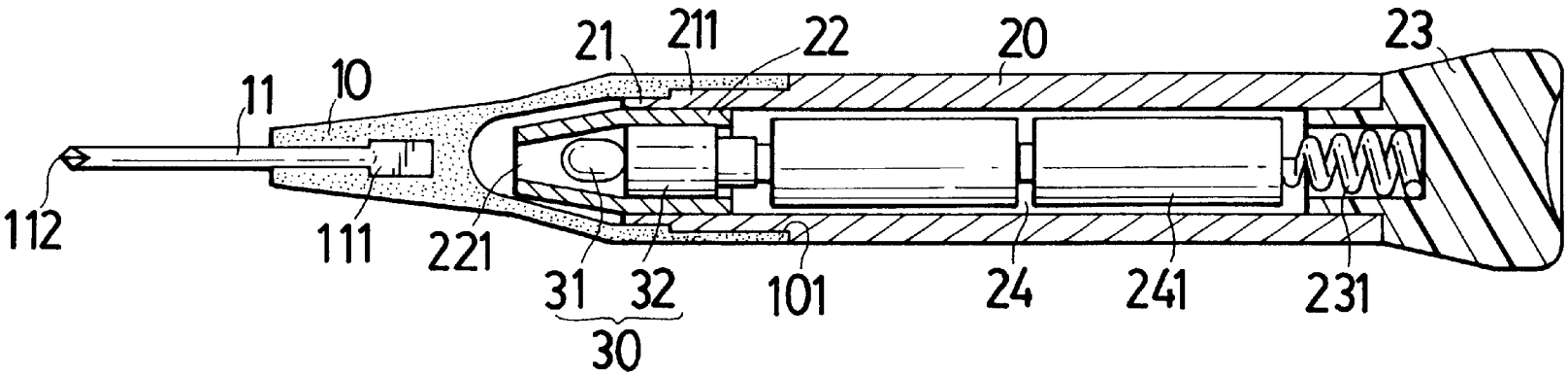
FIG. 4 is the sectional plan of FIG. 2 without illumination.

FIG. 3 and 4 indicate that the inner diameter of forward cover 22 is fixed with a turning control switch 32 which converts turning dynamic energy into clearance expansion touch control. The side of turning control switch 32 that faces the lamp hole 221 is equipped with a light bulb 31. These above parts configure a light source component 30.

Since the main body 20 of the gripping rod 2 is threaded with the forward cover 22 and the tail cover 23 respectively, therefore, its interior is a closed space and form a battery compartment 24, to contain battery 241. From left hand side of drawing to the right hand side of drawing, according to the order, they are: light bulb 31, turning control switch 32, battery 241, and spring 231, etc to combine a complete circuit.

In FIG. 3, the forward cover 22 is the distance preset to turn inner forwarding. It actuates turning control switch 32 to move along with the axis direction of gripping rod 2 (decreases the clearance), and then conduct power supply to force light bulb 31 producing light source. The lights will go out and illuminate through lamp hole 221 and female joint cover 10.

In FIG. 4, turn the forward cover 22 outer forwarding. It will actuate turning control switch 32 to move along with the axis direction of gripping rod 2 (increases the clearance), and cutout power supply, then light bulb 31 can not produce light source for illuminating.

Figure 6:
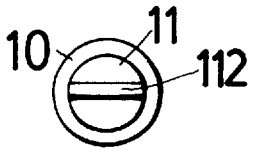
FIG. 6 is one of the plans of bit shape in FIG. 1.
Figure 7:
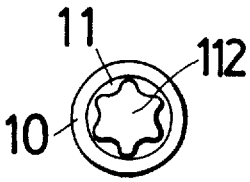
FIG. 7 is one of the plans of bit shape in FIG. 1.
Figure 8:
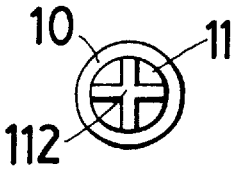
FIG. 8 is one of the plans of bit shape in FIG. 1.

FIG. 6,7 and 8 indicate the shape of bit 112, from left hand side of drawing to the right hand side of drawing, according to the order, they are: "straight line shape", "polygonal shape", and "crossing shape".

This implementation example has the following advantages:

a) It can match with the Extractor of several different shapes of bits. It can be extracted and assembled at any time depending on the requirements. Since its configuration is very simple, therefore, the operation and replacement is quite convenient.

b) Since the light source is closed to the bit, therefore, it can provide more illumination than existing screwdriver against the surrounding circumstances of the poor sight places or the threaded locking component (screw).

c) The female joint cover itself is colored, it can converts light beam into different colors, as well as to provide users with the inspiration of colors to memorize or search the extractor of different shape of bits.

From above, no matter if the inserting section main body is used as a gripping rod solely to couple with the extractor as a screwdriver. Or change the turning control switch of light, source component to a pressing type of switch, pushing type of switch, or other types of switches as the ways of electricity conducting, they all should be treated as the equivalent. And therefore, are included in the scope of this patent claim.

What the invention claimed is:

1. A screwdriver comprising:

(a) an extractor including a female joint cover having a first hollow cylindrical end and a second end, the first hollow cylindrical end having an inner toothed circumferential positioning section disposed therein, the second end having a rod body extending therefrom and terminating in a bit; and (b) a gripping rod including a tubular main body having a first end and a second end, the first end being of reduced diameter and having an outer toothed circumferential inserting section engageable with the inner toothed circumferential positioning section for transmitting torque to the bit.

2. The screwdriver of claim 1 wherein the female joint cover is formed of a material that permits light to penetrate therethrough.

3. The screwdriver of claim 1 further including:

a) a forward cover disposed within the first end of the main body, an end of the forward cover having a lamp hole containing a light source component that includes a light bulb and a turning control switch for converting turning dynamic energy into a clearance expansion touch control; and b) a tail cover engageable with the second end of the main body to define a compartment therewith, a battery power source disposed within the compartment for connection to the light bulb by the turning control switch, and the tail cover including a spring for engaging the power supply.

* * * * *